United States Patent [19]

Grenier

[11] Patent Number: 4,479,540

[45] Date of Patent: Oct. 30, 1984

[54] GASIFICATION OF COAL

[75] Inventor: Maurice Grenier, Paris, France

[73] Assignee: L'Air Liquide, Societe Anonyme Pour L'Etude et L'Exploitation des Procedes Georges Claude, Paris, France

[21] Appl. No.: 381,623

[22] Filed: May 24, 1982

[30] Foreign Application Priority Data

Jun. 5, 1981 [FR] France ..... 81 11149

[51] Int. Cl.[3] ..... E21B 43/243; E21C 43/00

[52] U.S. Cl. ..... 166/260; 166/261; 48/DIG. 6

[58] Field of Search ..... 166/261, 260, 256, 57, 166/59, 222, 223; 175/12, 14, 15, 17, 64, 67; 48/DIG. 6

[56] References Cited

U.S. PATENT DOCUMENTS

| | | | |
|---|---|---|---|
| 2,680,486 | 6/1954 | Carpenter | 175/12 X |
| 2,902,270 | 9/1959 | Salomonsson et al. . | |
| 3,093,197 | 6/1963 | Freeman . | |
| 3,563,606 | 2/1971 | Sears | 175/12 X |
| 3,572,839 | 3/1971 | Okabe | 299/17 |
| 4,010,801 | 3/1977 | Terry . | |
| 4,067,390 | 1/1978 | Camacho . | |
| 4,078,613 | 3/1978 | Hamrick . | |
| 4,136,737 | 1/1979 | Howard et al. . | |
| 4,185,692 | 1/1980 | Terry | 166/261 X |
| 4,301,875 | 11/1981 | Munding et al. | 175/12 |
| 4,356,866 | 11/1982 | Savins | 166/261 |

FOREIGN PATENT DOCUMENTS

| | | |
|---|---|---|
| 2313439 | 12/1976 | France . |
| 2461871 | 2/1981 | France . |

*Primary Examiner*—Stephen J. Novosad

*Attorney, Agent, or Firm*—Young & Thompson

[57] ABSTRACT

This invention relates to the gasification of coal. An oxygen jet having a pointed flame is engendered in situ, so as to strike the coal with a sheath of steam. The resultant fuel gas is drawn off while flowing in counterflow with the jet of oxygen and is brought to the surface through the same bore which had served the purpose of supplying oxygen. The invention is particularly applicable to the underground gasification of coal in situ.

9 Claims, 6 Drawing Figures

GASIFICATION OF COAL

BACKGROUND OF THE INVENTION

The present invention relates to processes for the underground gasification of coal, of the kind in which a gasifying agent is ducted through a bore, to be ejected in situ in the direction of a seam of coal, from which is extracted a fuel gas resulting from an incomplete combustion of the said coal, said fuel gas being ducted to the surface while flowing in counterflow and around said jet of gasifying agent and then being ducted to the surface via said bore.

It is known that there is thus assured the formation of a fuel gas commonly containing at least carbon monoxide, and very variable quantities of methane. The interest inherent in this process is that it utilizes a single bore only for the products fed in and the fuel drawn off, but the problem thus presented is to avoid any complementary combustion reaction between the gasifying agent and the fuel gas resulting from the incomplete combustion and, to this end, the methods hitherto used consisted either in constantly causing forward feed of the head supplying the gasifying agent until it reached the direct vicinity of the coal face at which the combustion takes place, which produces disadvantages regarding control and thermal shock, or in diluting the gasifying agent within expelled protective capsules flowing by gravity towards the combustion face.

It is an object of the invention to simplify the means applied to provide in situ gasification of coal, in particular found at very great depth, by considerably simplifying the means applied and by providing a precise check on the incomplete combustion phenomenon.

SUMMARY OF THE INVENTION

In accordance with the invention, the jet of gasifying agent is a gaseous jet and an annular sheet of an insulating fluid is expelled between said jet of gasifying agent and said flow of fuel gas flowing in counterflow to said jet of gasifying agent.

The fluid of the annular sheet is preferably water, if appropriate in the form of steam. In this manner, due to the isolation of the gasifying jet, a substantial distance may be established between the head supplying the gasifying agent and the combustion face, while preventing any complementary complete combustion reaction. Furthermore, it is possible by means of appropriate measurements, to perform perfect monitoring of the incomplete combustion space and thus to secure a gas of constant quality.

The invention also consists in apparatus for carrying out the process of the invention.

BRIEF DESCRIPTION OF THE DRAWINGS

In order that the invention may be more clearly understood, reference will now be made to the accompanying drawings, which show certain embodiments thereof by way of example and in which.

DETAILED DESCRIPTION OF PREFERRED EMBODIMENTS

Figure 1:
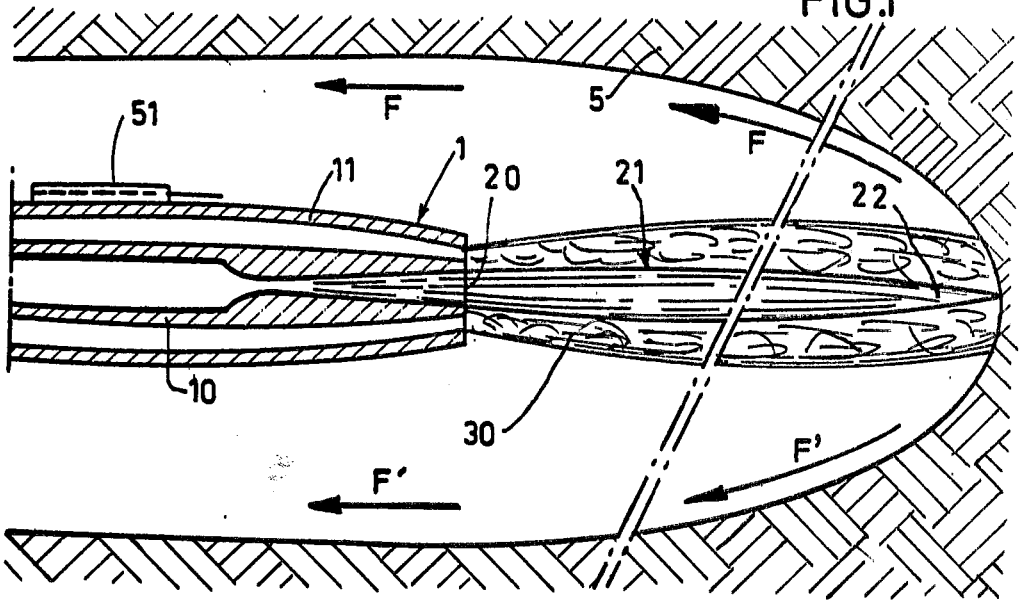
FIG. 1 is a diagrammatical view at the locus of the incomplete combustion space.
Figure 2:
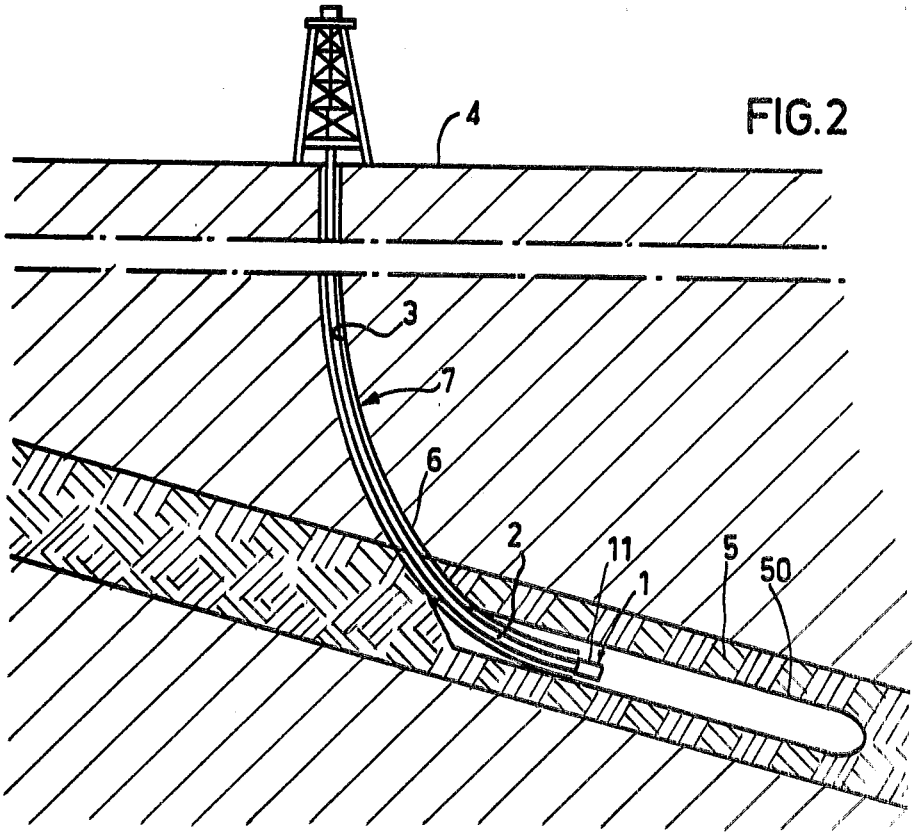
FIG. 2 is a diagrammatical view of the bore.

Referring now to FIGS. 1 and 2 of the drawings, it will be seen therefrom that a nozzle 1 at the end of a pipe 2 located within a bore 3 extending from the surface 4 to a coal seam 5 is situated in a central portion of the coal seam 5. This nozzle 1 comprises a preferably supersonic blast nozzle 10 of convergent-divergent form and a co-axial pipe 11 which is also connected to the pipe 2 which is in the form of a double pipe, the central pipe being connected to the central nozzle pipe 10, the other co-axial pipe being connected to the co-axial nozzle pipes 11. The central nozzle pipe 10 is supplied with oxygen under pressure, whereas the annular pipes 11 are supplied with steam under pressure.

The nozzle 1 operates in the following manner: through its calibrated orifice 20, a concentrated and directional jet of oxygen 21 emerges in elongated form and at supersonic speed and has a pointed flame 22 the tip of which impinges against the coal, whereas the steam flows around the jet 21 in an annular curtain 30 which extends over at least a large proportion of the extension of the directional jet 21. At the point of impact, the oxygen causes the incomplete combustion of the coal. An annular flow of combustible or fuel gas at high temperature rises along the arrows FF' around the combined oxygen jet and steam curtain. During its trajectory, the gas cools in contact with the layer of carbon and the steam, the resulting chemical reactions considerably increasing its calorific capacity. This fuel gas is tapped off at the bottom of the borehole via a second annular pipe 6 formed by a sheath 7 surrounding and spaced from the double tubular duct 2. It will be observed that the steam not only forms an active element in the incomplete combustion, but also plays a decisive part in preventing contact between the fuel gas and the pointed oxygen flame; without this steam curtain, or another separating means, the fuel gas would be oxidized while travelling abreast of the oxygen, which would clearly prevent the partial gasification sought. This is true, the more so since the directional oxygen jet 21, may have a very great extension in the axial direction, since the distance between the pointed flame 22 and the nozzle 1 may amount to several tens of meters.

Figure 3:
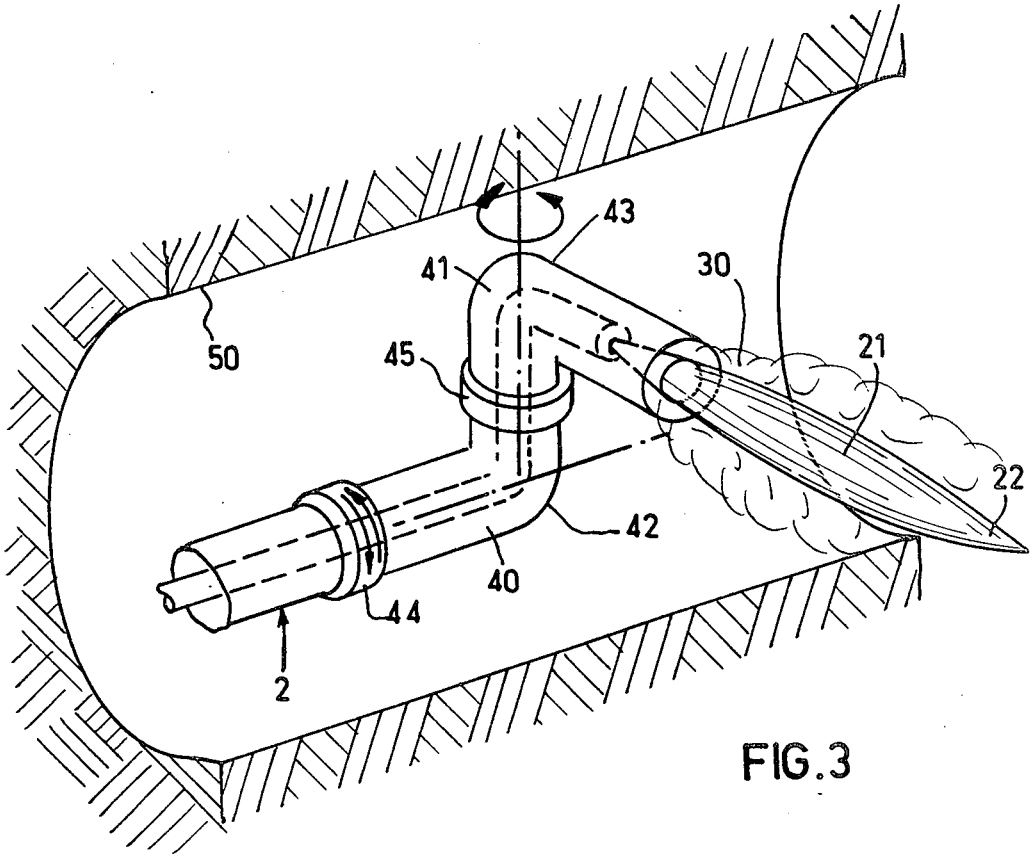
FIG. 3 is an enlarged scale view in schematic form of the end of the duct leading to the injection nozzle.
Figure 4:
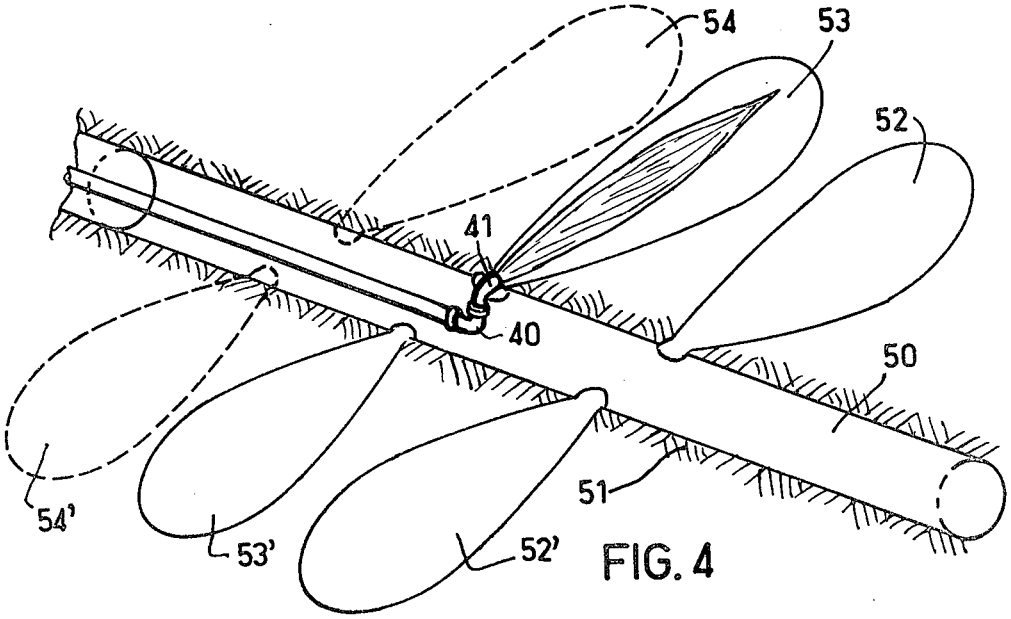
FIG. 4 is a diagrammatical view of the mode of operation.

In practice, as shown in FIG. 3, the composite oxygen and steam nozzle is situated at the end of a double pipe 2 which has two consecutive sections 40 and 41, each having a right-angled elbow 42 and 43, these two sections 40 and 41 being connected by two revolving joints 44 and 45. In practice, the operation is performed in the following manner:

Drilling is undertaken as shown in FIG. 2 until the coal seam 5 is reached, when the pipes 2 and 6 are inserted while fitting the pipe 2 with the device comprising rotary joints illustrated in FIG. 3. At this position, the elbow sections 40 and 41 are placed in alignment and the first partial combustion stage is performed, which starting from ground level, consists in increasing the length of the pipe 2 so that it may be displaced along a central portion of the seam 5, the tip nozzle 11 forming a mine drift 50 by incomplete combustion, which is a kind of "oxygen" cut bore in the plane of the coal seam and this bore may reach several hundred meters. This operation is carried out by adding pipe sections at ground level and by permanent correction of the direction of feed by monitoring the combustion space by means of an optical temperature gauge 51 (FIG. 1) in unit with the nozzle 11 and which renders it possible to check whether the impact of the oxygen jet occurs satisfactorily on the coal layer. Once the mine drift 50 is formed, lateral combustion operations (FIG. 4) are undertaken along this drift by resetting the pipe sections 40 and 41 in directions in such manner as to aim the nozzle 11 in the greater transverse extension of the coal seam 51, and incomplete combustion operations are thereupon performed in transverse planes at right angles to the mine drift 50 thus producing either mutually staggered combustion recesses 52, 53, 54, and 52', 53', 54', or, if appropriate, a large cavity extending at either side of the mine drift 50.

This incomplete combustion operation which is performed within the mass of coal which had not undergone any hazardous preparation such as a breaking operation, may consequently be implemented with a maximum chance of success, given that this mass of coal then has a mass uniformity rendering the incomplete combustion reproducible at all points. It will be observed moreover that the optical monitoring device 51 renders it possible, by means of laterally directed combustion operations, to check on whether the setting is always in alignment with a central position of the coal seam, since this monitoring device 51 allows of immediate detection of any drop in temperature when the pointed flame 22 of the direction jet 21 of oxygen strikes rock.

It will be noted that the invention may be applied in a variety of forms of which some are listed by way of example:

it was observed that one of the parts played by the steam consisted in isolating the jet of oxygen from the gases resulting from the incomplete combustion. This part may also be played by an inert gas such as carbon dioxide.

Instead of operating by continuous injection of oxygen with gaseous insulating sheath, it is also possible to work by sequences of injections of oxygen followed by hydrogen, and in this case it is no longer necessary to provide a gaseous protection for the jet of active hydrogen.

Figure 5:
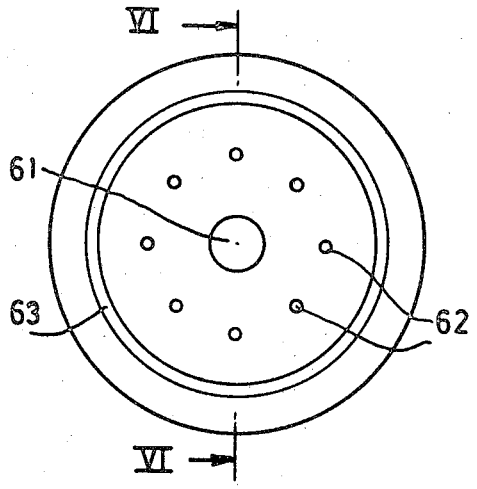
FIG. 5 is a diagrammatical view of a modified form of nozzle.
Figure 6:
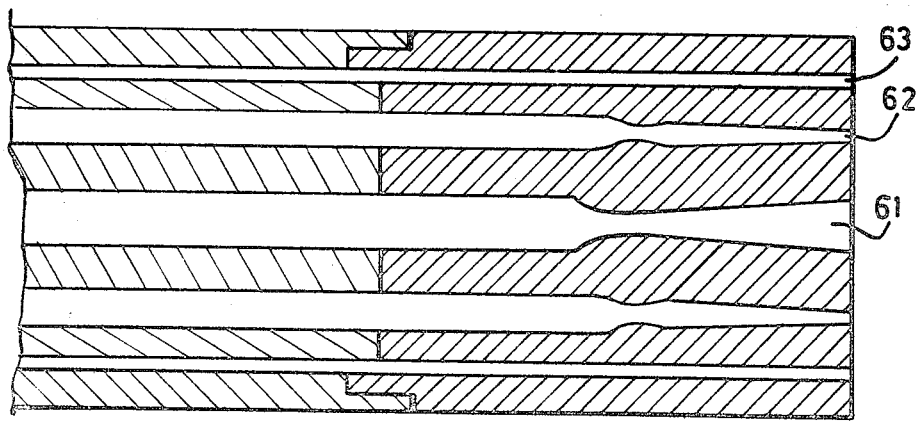
FIG. 6 is an axial section along the line VI—VI of FIG. 5.

It is also possible to apply a more complex injection comprising a central jet of oxygen sheathed in an annular intermediate steam jet or carbon dioxide jet, and in a peripheral annular jet of hydrogen or steam (in particular if the intermediate jet is of another substance than steam), as illustrated in FIGS. 5 and 6, wherein are shown the outlet of a supersonic nozzle 61 for the oxygen, an annular ring of outlets 62 for the steam of water flowing at high speed, and an annular slot 63 for steam in laminar flow.

I claim:

1. A process for the underground gasification of coal, comprising drilling a blind bore extending to a coal seam, said bore having a peripheral wall and an end wall, ejecting within said coal seam and toward said end wall a central gaseous jet of a gasifying agent and a peripheral substantially annular jet of a separating fluid, said substantially annular jet being ejected substantially parallel to and around and in the same direction as said central jet so as to form an annular sheet of said separating fluid around said central jet, and extracting from said bore a fuel gas resulting from an incomplete combustion of said coal, said fuel gas flowing from said bore end wall between said bore peripheral wall and said annular sheet.

2. A process according to claim 1, wherein said separating fluid is selected from the group consisting of water and steam.

3. A process according to claim 1, wherein the gasifying agent is oxygen.

4. A process according to claim 1, wherein said separating fluid results from the vaporization of water injected at the bore entry and which is heated by heat exchange with the fuel gas rising to the surface.

5. In a process for the underground gasification of coal, of the kind in which a gasifying agent is ducted through a bore, to be ejected in situ in the direction of a coal seam, from which is extracted a fuel gas resulting from an incomplete combustion of the said coal, said fuel gas being ducted to the surface while flowing in counterflow and around said jet of gasifying agent and then being ducted to the surface through said bore; the improvement in which said jet of gasifying agent is a gaseous jet, and projecting an annular sheet of an inert gas in the same direction as said jet of gasifying agent between said jet of gasifying agent and said flow of fuel gas flowing in counter-flow with said jet of gasifying agent.

6. In a process for the underground gasification of coal, of the kind in which a gasifying agent is ducted through a bore, to be ejected in situ in the direction of a coal seam, from which is extracted a fuel gas resulting from an incomplete combustion of the said coal, said fuel gas being ducted to the surface while flowing in counterflow and around said jet of gasifying agent and then being ducted to the surface through said bore; the improvement in which said jet of gasifying agent is oxygen, intermittently replacing said oxygen by hydrogen, and projecting an annular sheet of separating fluid in the same direction as said jet of gasifying agent between said jet of gasifying agent and said flow of fuel gas flowing in counterflow with said jet of gasifying agent.

7. In a process for the underground gasification of coal, of the kind in which a gasifying agent is ducted through a bore, to be ejected in situ in the direction of a coal seam, from which is extracted a fuel gas resulting from an incomplete combustion of the said coal, said fuel gas being ducted to the surface while flowing in counterflow and around said jet of gasifying agent and then being ducted to the surface through said bore; the improvement in which said jet of gasifying agent is a gaseous jet, projecting an annular sheet of separating fluid in the same direction as said jet of gasifying agent between said jet of gasifying agent and said flow of fuel gas flowing in counterflow with said jet of gasifying agent, and injecting a second gas at the outer periphery of said annular sheet of separating fluid.

8. A process according to claim 7, wherein said second gas is selected from the group consisting of steam, carbon dioxide and hydrogen.

9. In a process for the underground gasification of coal, of the kind in which a gasifying agent is ducted through a bore, to be ejected in situ in the direction of a coal seam, from which is extracted a fuel gas resulting from an incomplete combustion of the said coal, said fuel gas being ducted to the surface while flowing in counterflow and around said jet of gasifying agent and then being ducted to the surface through said bore; the improvement in which said jet of gasifying agent is a gaseous jet, projecting an annular sheet of separating fluid in the same direction as said jet of gasifying agent between said jet of gasifying agent and said flow of fuel gas flowing in counterflow with said jet of gasifying agent, performing an initial gasifying operation in a line to form a mine drift having a central extension within the coal seam, and thereafter successively performing a plurality of lateral gasifying operations stepped along and at either side of the said mine drift.

* * * * *